US007082727B2

(12) United States Patent
Schmidt

(10) Patent No.: US 7,082,727 B2
(45) Date of Patent: Aug. 1, 2006

(54) HUNG WINDOW WITH SNAP-FIT ASSEMBLY

(75) Inventor: Helmut Schmidt, Unionville (CA)

(73) Assignee: Industries Covers Inc., Quebec (CA)

( * ) Notice: Subject to any disclaimer, the term of this patent is extended or adjusted under 35 U.S.C. 154(b) by 235 days.

(21) Appl. No.: 10/616,963

(22) Filed: Jul. 11, 2003

(65) Prior Publication Data

US 2004/0226234 A1 Nov. 18, 2004

Related U.S. Application Data

(60) Provisional application No. 60/470,897, filed on May 16, 2003.

(51) Int. Cl.
*E06B 3/988* (2006.01)

(52) U.S. Cl. ..... 52/204.71; 52/656.5; 52/204.61; 52/208.69; 49/308

(58) Field of Classification Search ..... 52/204.71, 52/204.54, 656.5, 656.9, 717.01, 456, 204.61, 52/656.7, 660, 664, 204.69, 205, 204.51, 52/204.62, 204.66; 49/308, 505
See application file for complete search history.

(56) References Cited

U.S. PATENT DOCUMENTS

| | | | | |
|---|---|---|---|---|
| 3,881,290 | A * | 5/1975 | Bouchey | 52/204.593 |
| 4,361,994 | A * | 12/1982 | Carver | 52/238.1 |
| 4,530,195 | A | 7/1985 | Leopold | |
| 4,640,048 | A | 2/1987 | Winner et al. | |
| 4,753,056 | A | 6/1988 | Pacca | |
| 4,922,656 | A | 5/1990 | Giguere | |
| 5,177,916 | A | 1/1993 | Misera et al. | |
| 5,313,761 | A | 5/1994 | Leopold | |
| 5,351,451 | A | 10/1994 | Misera et al. | |
| 5,361,476 | A | 11/1994 | Leopold | |
| 5,617,699 | A | 4/1997 | Thompson, Jr. | |
| 5,644,881 | A * | 7/1997 | Neilly | 52/455 |
| 5,653,073 | A | 8/1997 | Palmer | |
| 5,655,282 | A | 8/1997 | Hodek et al. | |
| 5,682,714 | A | 11/1997 | Ishikuro et al. | |
| 5,692,349 | A | 12/1997 | Guillemet | |
| 5,836,119 | A | 11/1998 | Emmanuel | |
| 5,887,391 | A * | 3/1999 | Shoup | 52/202 |
| 6,009,929 | A * | 1/2000 | Linderman et al. | 160/104 |
| 6,012,258 | A * | 1/2000 | Brown et al. | 52/239 |
| 6,119,756 | A * | 9/2000 | Tatro | 160/107 |
| 6,170,555 | B1 * | 1/2001 | Welfonder | 160/381 |
| 6,425,215 | B1 * | 7/2002 | Farrar | 52/204.5 |
| 6,506,112 | B1 * | 1/2003 | Halbleib et al. | 454/225 |
| 6,679,013 | B1 * | 1/2004 | Hornung | 52/204.62 |
| 2002/0124494 | A1 | 9/2002 | Zen | |
| 2003/0079414 | A1 | 5/2003 | Rangabasyam et al. | |

FOREIGN PATENT DOCUMENTS

| | | |
|---|---|---|
| WO | WO 92/08030 | 5/1992 |
| WO | WO 98/25001 | 6/1998 |

* cited by examiner

*Primary Examiner*—Basil Katcheves
*Assistant Examiner*—Chi Q. Nguyen
(74) *Attorney, Agent, or Firm*—Nixon & Vanderhye P.C.

(57) ABSTRACT

A window assembly which includes at least some components which may be assembled in a snap-fit manner. In certain example embodiments, a combination of rotation/pivoting insertion, and a snap-fit assembly engagement of one or more components may be utilized in assembly. For example, a component may be engaged with a portion of another component, and then rotated and/or pivoted about a pivot axis until a portion of the component becomes engaged with a part of the window in a snap-fit manner. The combined use of rotation/pivoting about a pivot axis and snap-fit engagement allows for self-alignment to be realized during assembly thereby simplifying the assembly process.

7 Claims, 9 Drawing Sheets

1 Insect Screen
2 Mask of Fixed Glazing
3 Fixed glazing
4 Mask of Mobile Sash
5 Exterior Sash Frame
6 Glazing of Sash
7 Interior Sash Frame
8 Exterior Main Frame
9 Interior Main Frame
10 U-Gasket
11 Gasket for Mullion
12 Mullion Insertion of Exterior Sash Frame (5)
to Interior Sash Frame (7)

Insertion of Exterior Mask (2)
to Exterior Main Frame (8)

Insertion of Sash (14)

Insertion of Mask (4)

Insertion of Insect Screen (1)

Insertion of Interior Frame (9)

Fixed Glazing - Horizontal Cross Section

Mobile Sash - Horizontal Cross Section

HUNG WINDOW WITH SNAP-FIT ASSEMBLY

This application claims priority on U.S. Provisional Application No. 60/470,897, filed May 16, 2003, the disclosure of which is hereby incorporated herein by reference.

This application relates to a window which may be assembled using a plurality of snap-fitting components. In certain example embodiments a single-hung window or the like may be assembled via a plurality of snap-fit steps. Such windows, which may be molded in certain example embodiments, may be used in the context of door windows, solarium windows, cottage windows, shed windows, residential home windows, and/or the like.

BACKGROUND OF THE INVENTION

Hung windows are known in the art. For example, certain hung windows include a fixed glazing and a mobile glazing, where the mobile glazing may be moved relative to the fixed glazing during operation, repair or the like.

Unfortunately, certain components of typical window assemblies are often held together by fasteners which may require special tools to install/remove, and/or which lead to time-consuming assembly.

Certain snap-fit assemblies are also known in the window art. For example, see U.S. Pat. Nos. 4,753,056; 5,692,349 and 5,836,119, all of which are hereby incorporated herein by reference. Unfortunately, the snap-fit assemblies of these patents are often undesirable for one or more reasons such as alignment problems, efficiency of assembly problems, durability and/or longevity problems of the assembled product, security problems, and/or the like.

It will be appreciated by those skilled in the art that there exists a need in the art for a snap-fit window assembly design which is at least one of: (a) easy to assemble, (b) capable of realizing good security, (c) capable of providing self-alignment during assembly of components, and/or (d) durable and capable of realizing longevity.

BRIEF SUMMARY OF THE INVENTION

This invention relates to a window assembly which includes at least some components which may be assembled in a snap-fit manner. The need for fasteners may be reduced and/or eliminated in certain embodiments.

In certain example embodiments, a combination of (i) rotation/pivoting insertion, and (ii) snap-fit assembly of one or more components is utilized. For example, a component may be engaged with a portion of another component, and then rotated and/or pivoted about a pivot axis until a portion of the component becomes engaged with a part of the window in a snap-fit manner. The combined use of rotation/pivoting about a pivot axis with snap-fit engagement has surprisingly been found to allow for self-alignment to be realized during assembly.

In certain example embodiments of this invention, there is provided a window comprising: a glazing at least partially supported by, and located partially between, first and second sash frames; and wherein the first sash frame comprises pivot means for pivotal engagement with the second sash frame, and snap-fit engagement means for snap-fit engagement with the second sash frame, so that said pivot means and snap-fit engagement means are for permitting the first sash frame to be attached and/or removed from the second sash frame by way of pivoting and snap-fit engagement and/or removal.

In other example embodiments of this invention, there is provided a window comprising: a glazing at least partially supported by, and located partially between, a mask and a frame member, each of the mask and frame member having an opening defined in a central area thereof; and wherein at least one of the mask and frame member comprises pivot means for pivotal engagement with the other of the mask and frame member, and snap-fit engagement means for snap-fit engagement with the other of the mask and frame member, so that said pivot means and snap-fit engagement means are for permitting said one of the mask and frame member to be attached and/or removed from the other of the mask and frame member by way of pivoting and snap-fit engagement and/or removal.

In still further example embodiments of this invention, there is provided a window comprising: a glazing at least partially supported by, and located partially between, first and second sash frames; a screen structure comprising a screen and a peripheral wall, wherein the screen structure is supported by at least a frame and/or mask member; and wherein the screen structure comprises pivot means for pivotal engagement with part of the window, and snap-fit engagement means for snap-fit engagement with the frame and/or mask member, so that said pivot means and snap-fit engagement means are for permitting the screen structure to be attached and/or removed from the frame and/or mask member by way of pivoting and snap-fit engagement and/or removal.

In still further example embodiments of this invention, there is provided a method of assembling a window, the method comprising: providing a glazing which is at least partially supported by a frame member; and pivotally engaging a mask with part of the frame member or a component supported by the frame member so as to define a pivot axis, and pivoting the mask about the pivot axis until another portion of the mask engages the frame member or a component supported by the frame member so as to provide a snap-fit connection between the mask and the frame member or a component supported by the frame member, with the glazing being located at least partially between at least part of the mask and at least part of the frame member.

In other example embodiments of this invention, there is provided window comprising: a fixed glazing at least partially covered by at least part of a fixed glazing mask; a movable glazing supported by, and located partially between, a movable glazing mask and a frame member, each of the movable glazing mask and frame member having an opening for viewing defined in a central area thereof; and wherein the movable glazing mask comprises pivot means for pivotal engagement with part of the fixed glazing mask so that when the pivot means of the movable glazing mask is engaged with the part of the fixed glazing mask the movable glazing mask is substantially pivoted about a pivot axis toward a final position; and wherein a screen structure is provided over at least part of the movable glazing mask, so that at least part of the movable glazing mask is located between respective parts of the screen structure and the movable glazing.

Any one of the example embodiments discussed above may or may not be used in combination with other of the example embodiments discussed above.

Each of the above-listed example embodiments may or may not be used in connection with other of the embodiments, in different aspects of the instant invention.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION OF EXAMPLE EMBODIMENTS OF THE INVENTION

Figure 1:
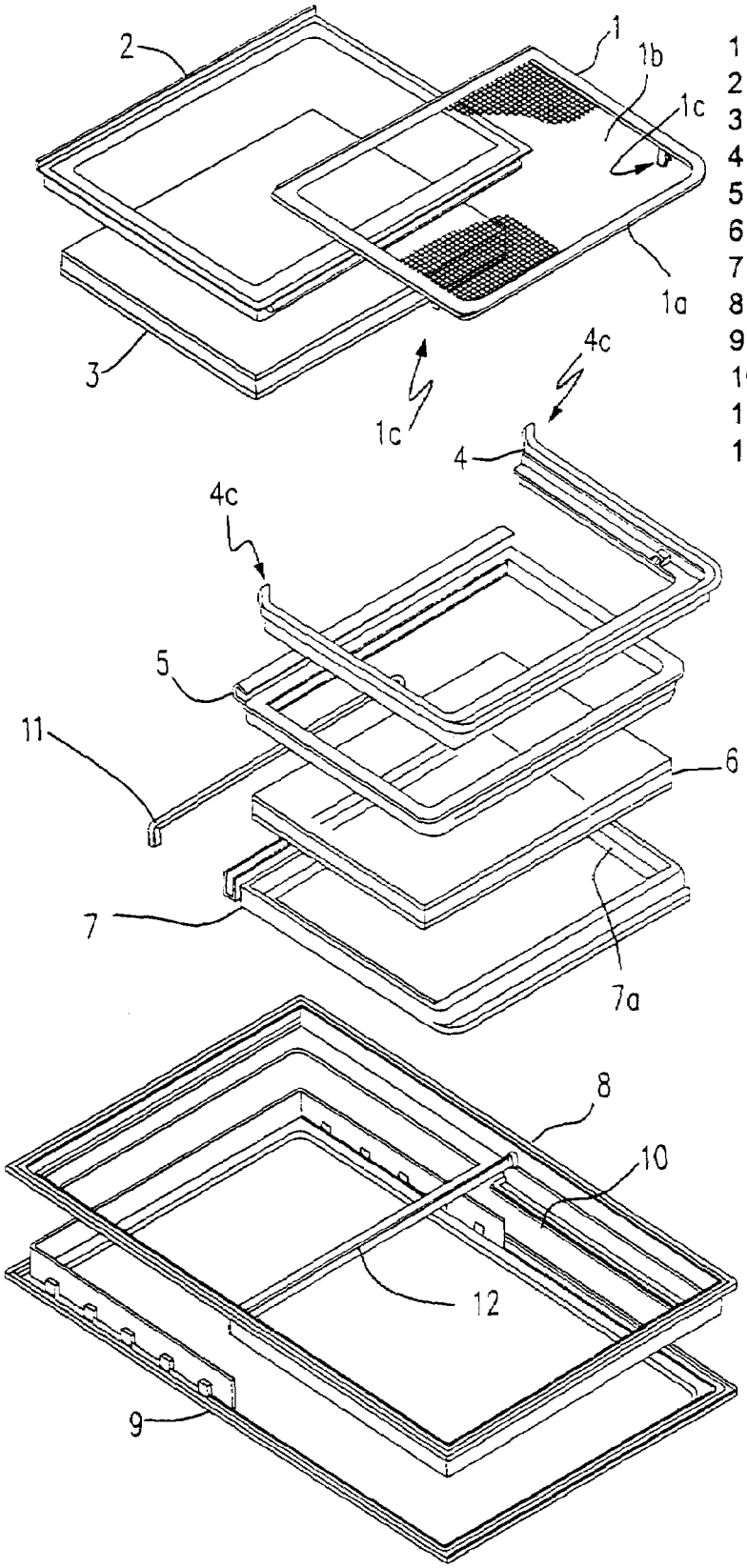
FIG. 1 is an exploded perspective view of various components of a window assembly which are to be assembled in making a window according to an example embodiment of this invention.

Referring now more particularly to the accompanying drawings in which like reference numerals indicate like parts throughout the several views.

Certain example embodiments of this invention relate to window structures which utilize at least some snap-fit components. In certain example embodiments, a combination of (i) rotation/pivoting insertion, and (ii) snap-fit assembly of one or more components is utilized in assembling at least one component of the window. For example, a component may be engaged with a portion of another component, and then rotated and/or pivoted about a pivot axis until a portion of the component becomes engaged with another part in a snap-fit manner. The combined use of rotation/pivoting about a pivot axis and snap-fit engagement has surprisingly been found to allow for self-alignment to be realized during assembly. Thus, assembly of the window is easier, more efficient, less time consuming, and/or leads to fewer assembly-related problems (e.g., potential for misalignment is reduced). When a sash component is attachable (e.g., insertable) in such a manner, for example and without limitation, this may be advantageous in that the need for special attachment tools may be avoided and/or reduced, the sash component may be easily removable, and/or the sash component may be easily repairable.

In certain example embodiments, the snap-fit attachments may only be accessible from the interior of the window/building/door, and/or if the sash has been raised or removed. Each of these ways in which the snap-fit attachments may be accessed is based upon access or actions taken on the interior side of the window, thereby allowing for good security to be realized.

Windows according to certain example embodiments of this invention may be used in the context of door windows which may be used in garage doors or any other type of doors, solarium windows, cottage windows, home windows, or in any other suitable window application. Certain example embodiments of this invention relate to single-hung molded windows, although certain embodiments of this invention may be used in the context of other types of windows.

FIG. 1 is an exploded view illustrating certain components of a window to be assembled according to an example embodiment of this invention. The components are illustrated in color in all figures except for FIG. 1 for purposes of simplicity and ease of understanding. The window includes insect screen 1, fixed glazing mask 2, fixed glazing 3, mobile sash mask 4, exterior sash frame 5, glazing 6, interior sash frame 7, exterior main frame 8, interior main frame 9, U-shaped gasket 10, mullion gasket 11, and mullion 12 which extends between opposing sides and/or edges of the frame 8 for support purposes and the like. In certain example embodiments, mask 2 at least partially covers a peripheral edge portion of glazing 3, and mask 4 at least partially covers a peripheral edge portion of glazing 6.

In certain example embodiments of this invention, each glazing 3 and 6 may be of the insulating glass (IG) window type so as to include a pair of spaced apart glass or plastic sheets. For example, glazing 3 as shown in other figures may include a pair of glass sheets 3*a* and 3*b* with space 3*c* defined therebetween. The space 3*c* may be filled with gas (e.g., argon) in certain example embodiments, although it need not be. In certain example embodiments, the space 3*c* may be at a pressure less than atmospheric, although it need not be in other embodiments. In a similar manner, glazing 6 may include a pair of glass sheets 6*a* and 6*b* with space 6*c* defined therebetween. While IG units are preferred in certain embodiments of this invention, other glazings may instead be used in other embodiments of this invention.

A color chart is set forth below for indicating the colors of certain components as shown in FIG. 2–9. Again, these colors have nothing to do with the final product herein, but are used in this application/patent for purposes of understanding and clarity of illustration.

Color Chart for FIGS. 2–9

| Component | Color |
|---|---|
| Insect Screen 1 | Blue |
| Fixed Glazing Mask 2 | Red |
| Fixed Glazing 3 | Blue |
| Mobile Sash Mask 4 | Black |
| Exterior Sash Frame 5 | Orange/Red |
| Glazing of Sash 6 | Blue |
| Interior Sash Frame 7 | Pink/Red |
| Exterior Main Frame 8 | Green |
| Interior Main Frame 9 | Red |

Figure 8:
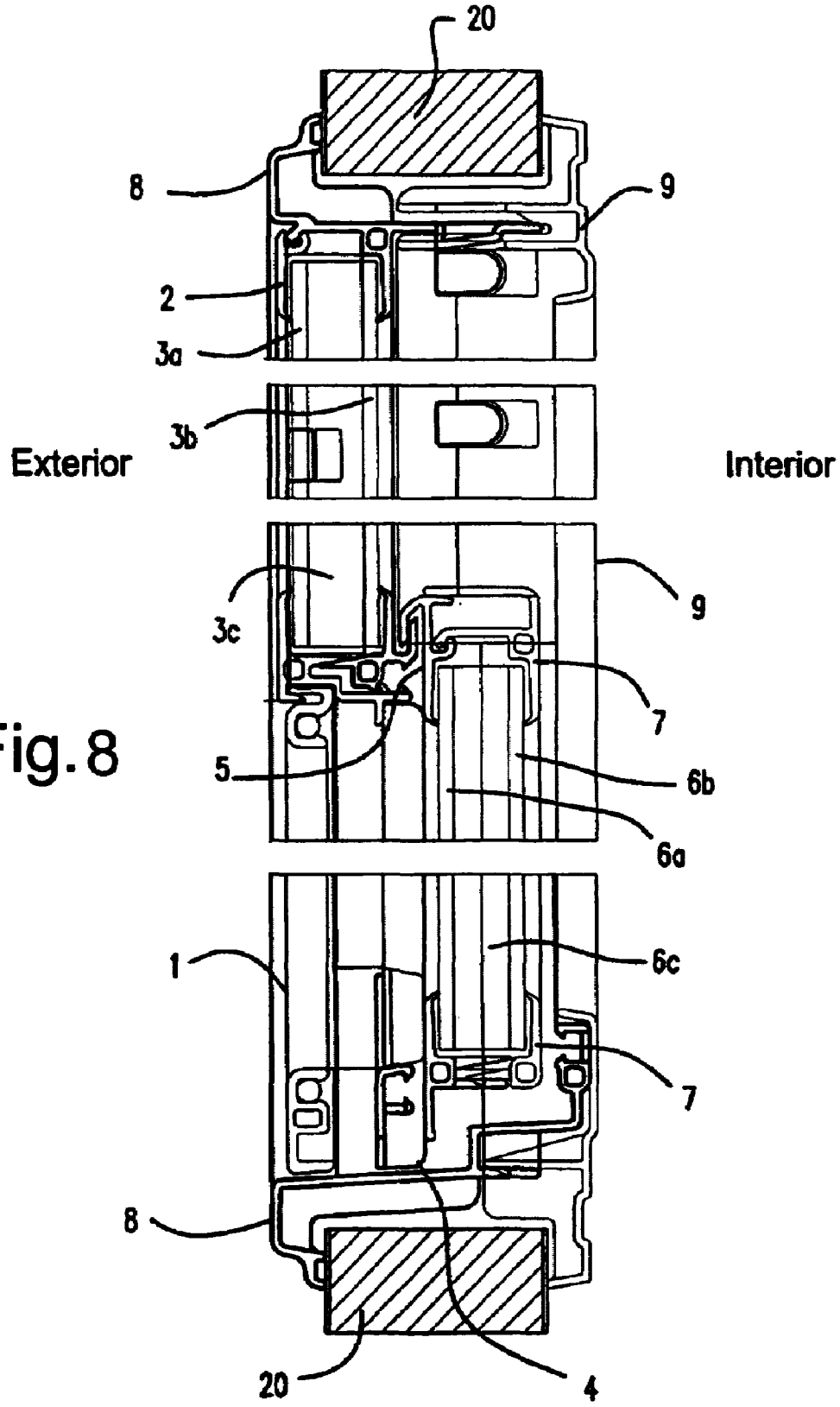
FIG. 8 is a vertical cross sectional view of a resulting window assembly (viewed from the side of the window) assembled in accordance with FIGS. 1–7 according to an example embodiment of this invention, where the fixed glazing is at a top portion of the figure and the mobile glazing is at the bottom portion of the figure.
Figure 9A:
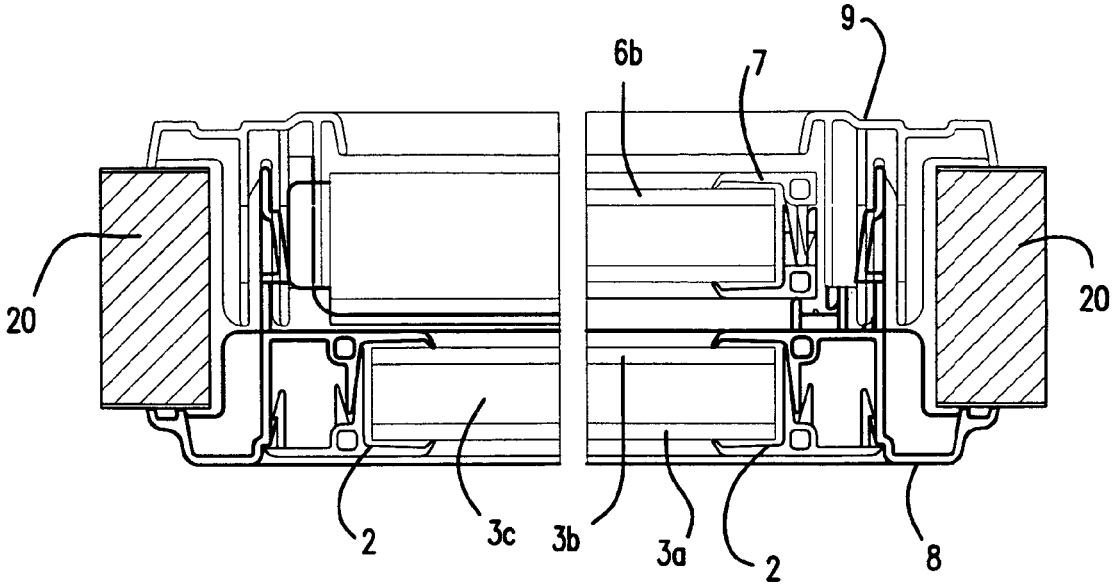
FIG. 9*a* is a horizontal cross sectional view of the fixed glazing portion of the window of FIG. 8 (viewed from above).
Figure 9B:
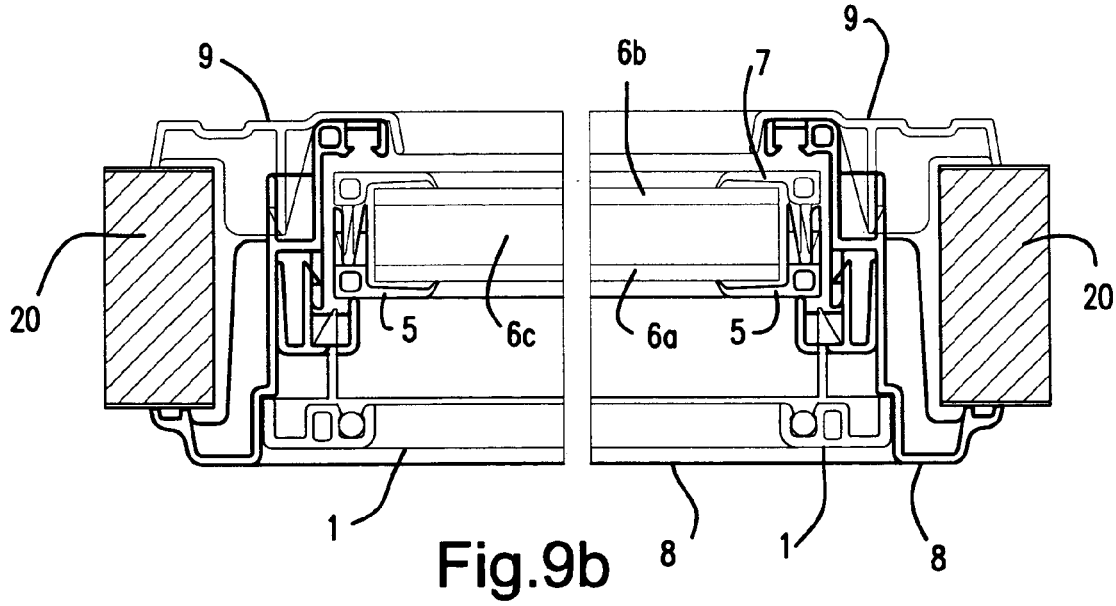
FIG. 9*b* is a horizontal cross sectional view of the mobile sash portion, sash mask and insect screen of FIG. 8 (viewed from above).

FIGS. 8–9 illustrate a window according to an example embodiment of this invention. FIG. 8 is a vertical cross sectional view of a resulting window assembly (viewed from the side of the window) where the fixed glazing is at a top portion of the figure and the mobile glazing is at the bottom portion of the figure. FIG. 9*a* is a horizontal cross sectional view of the fixed glazing portion of the window of FIG. 8 (viewed from above), and FIG. 9*b* is a horizontal cross sectional view of the mobile sash portion, sash mask and insect screen of FIG. 8 (viewed from above). It can be seen in FIGS. 8–9 that the window is installed for attachment to structure 20, with fixed glazing 3 and mobile (movable) glazing 6 being sandwiched between at least portions of exterior main frame 8 and interior main frame 9. The use of pivoting/rotation and snap-fit engagements in the window will be more fully explained below during description of the example technique for assembly shown in the other figures.

FIGS. 2–7 illustrate various steps undertaken during the method of assembling/making the window of FIGS. 8–9. This example method of assembly, with reference to FIGS. 2–7, is for purposes of example only and is not intended to be limiting unless claimed.

Figure 2:
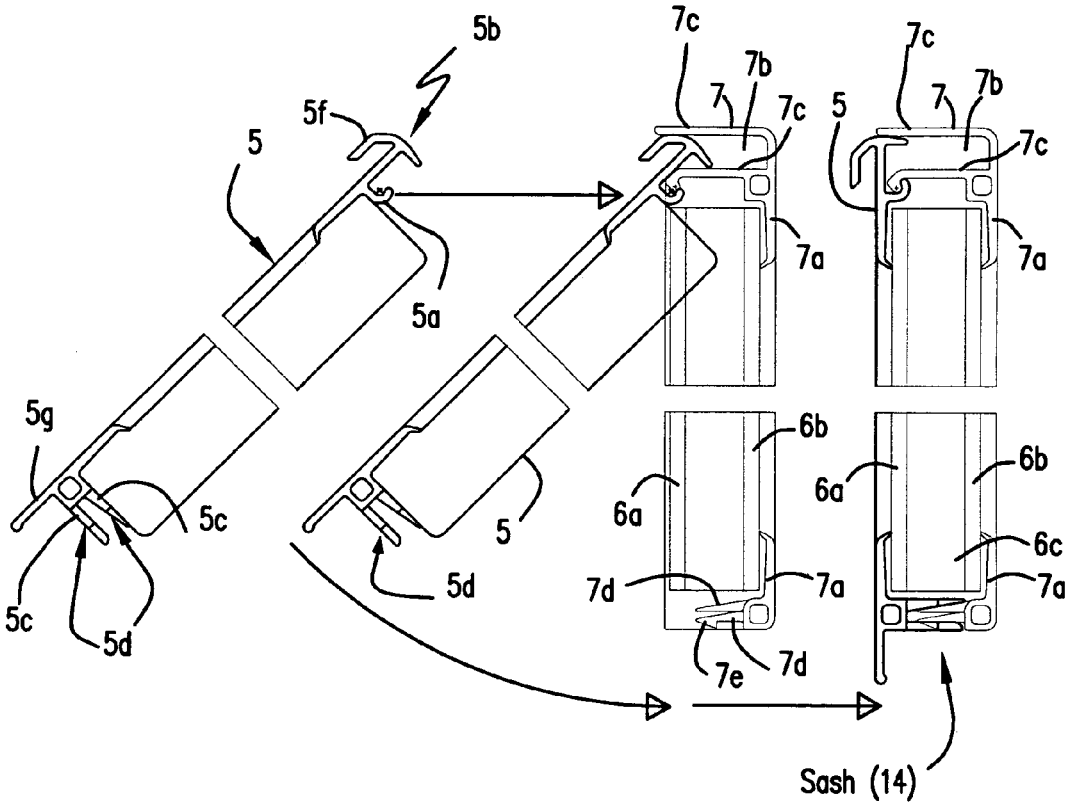
FIG. 2 is a schematic diagram illustrating the exterior sash frame being attached to at least the interior sash frame in a snap-fit manner according to an example embodiment of this invention.

FIG. 2 is a schematic diagram illustrating the exterior sash frame 5 being attached to at least the interior sash frame 7 in a snap-fit manner according to an example embodiment of this invention. Each sash frame 5, 7 has an opening or window (vision area) area defined in a central portion thereof (e.g., see FIG. 1). Referring to FIG. 2, it can be seen that glazing 6 is supported by interior sash frame 7. For example, the interior sash frame 7 may include support portion(s) 7*a* for supporting the glazing 6. Moreover, interior sash frame 7 may also include a channel 7*b* defined by a pair of approximately parallel side walls 7*c*, and first and second projections 7*d* including respective barbs 7*e* thereon for engagement with the exterior sash frame 5. Meanwhile, exterior sash frame 5 may include hook-shaped member 5*a*, approximately T-shaped edge support 5*b*, and first and second projections 5*c* including respective barbs 5*d* thereon for engagement with the interior sash frame 7.

In order to attach the exterior sash frame 5 to the interior sash frame 7, the hook-shaped member 5*a* of the exterior sash frame is engaged with an end of the inner side wall 7*c* of the interior sash frame having a protrusion thereon thereby defining a pivot axis (see the pivot axis "+" in FIG. 2) about which the exterior sash frame 5 is to approximately rotate/pivot during installation and/or removal. Once the hook-shaped member 5*a* is engaged, the exterior sash frame 5 is pivoted about axis + as shown by the arrows in FIG. 2 until the barbs 5*d* supported by projections 5*c* engage with opposing barbs 7*e* supported by projections 7*d* of the interior sash frame in a snap-fit manner. Thus, it can be seen that the snap-fit engagement is realized by the opposing barbs 5*d*, 7*e* and/or projections 5*c*, 7*d* of the exterior and interior sash frames, and the undercuts defined by the barbs supported by the projections. The assembled sash 14 is shown at the right-hand portion of FIG. 2. The sash frames may be disassembled by reversing these steps.

In alternative embodiments of this invention, only one projection and barb may be provided per sash frame, whereas in still further embodiments a barb from one of the sash frames 5, 7 may engage a recess in the other sash frame in order to accomplish to snap-fit attachment of sash frame 5 to sash frame 7. Such alternatives apply to all snap-fit connections herein in alternative embodiments of this invention.

Figure 3:
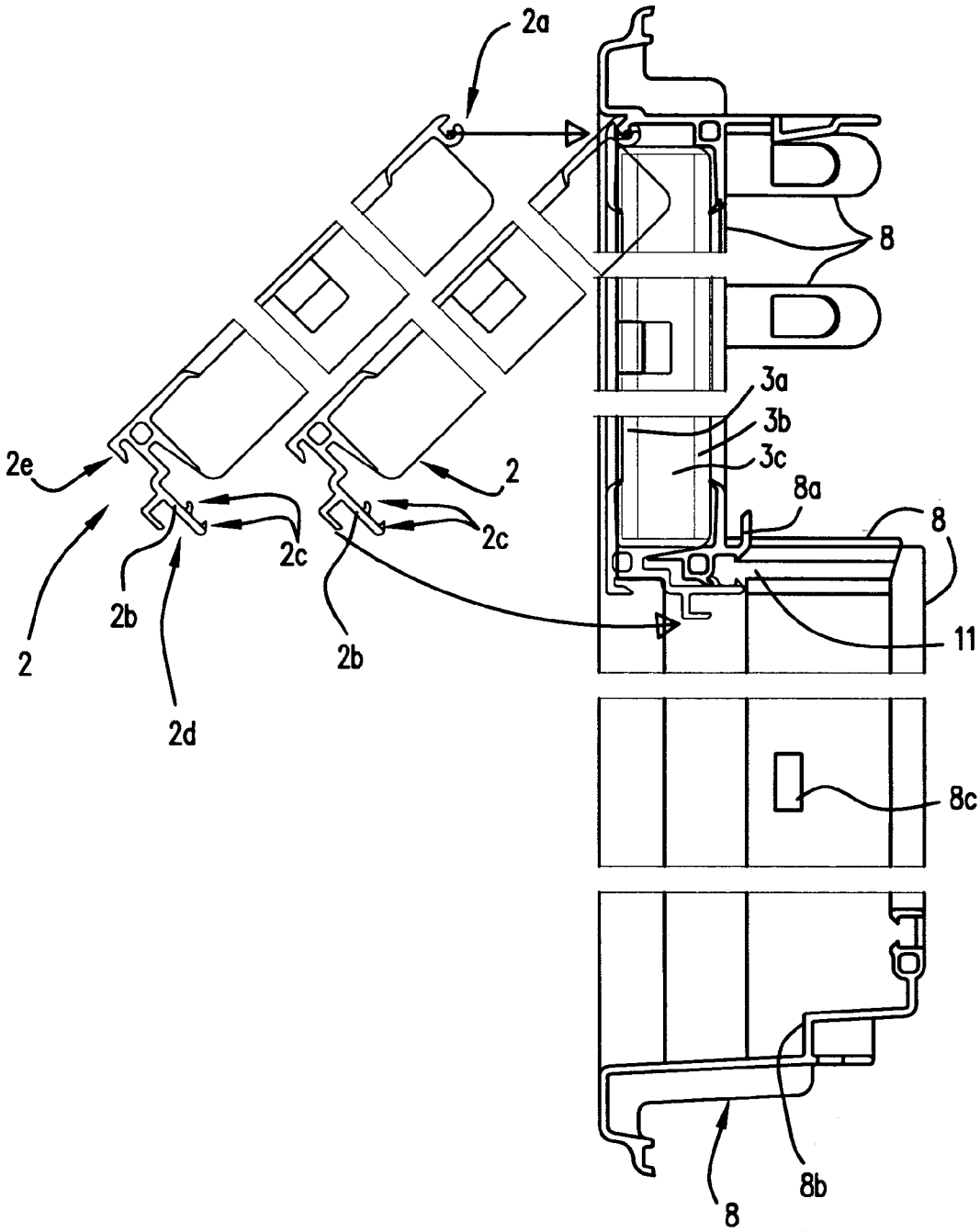
FIG. 3 is a schematic diagram illustrating the exterior mask being attached to at least the exterior main frame in a snap-fit manner according to an example embodiment of this invention.

FIG. 3 is a schematic diagram illustrating the exterior mask 2 being attached to at least the exterior main frame 8 in a snap-fit manner according to an example embodiment of this invention. This may be done before and/or after the FIG. 2 assembly of the sash is completed. Each of mask 2 and exterior main frame 8 has an opening or window area defined in a central portion thereof (e.g., see FIG. 1).

Referring to FIG. 3, the fixed glazing mask 2 includes curved and hook-shaped member 2*a* proximate an end thereof, and an elongated projection 2*b* proximate an opposite end thereof which has one or more barbs 2*c* thereon for engagement with the exterior main frame 8. In order to attach the mask 2 to the exterior main frame 8, the hook-shaped member 2*a* of the mask is engaged with a projection extending from part of the exterior main frame 8 thereby defining a pivot axis as shown in FIG. 3 about which the mask 2 is to approximately rotate/pivot during installation and/or removal. Once the hook-shaped member 2*a* is engaged, the mask 2 is pivoted about the pivot axis defined within part of the hook shaped member 2*a* as shown by the arrow in FIG. 3 until at least one barb 2*c* supported by projection 2*b* engages with an opposing barb and/or recess defined on or in the exterior main frame 8 (as shown in FIG. 3) or some other part of the window. Thus, due to the engagement of barb(s) 2*c*, the mask 2 is attached to the frame 8 in a snap-fit manner. As will be appreciated by those skilled in the art, the mask 2 may be removed by reversing these steps.

Figure 4:
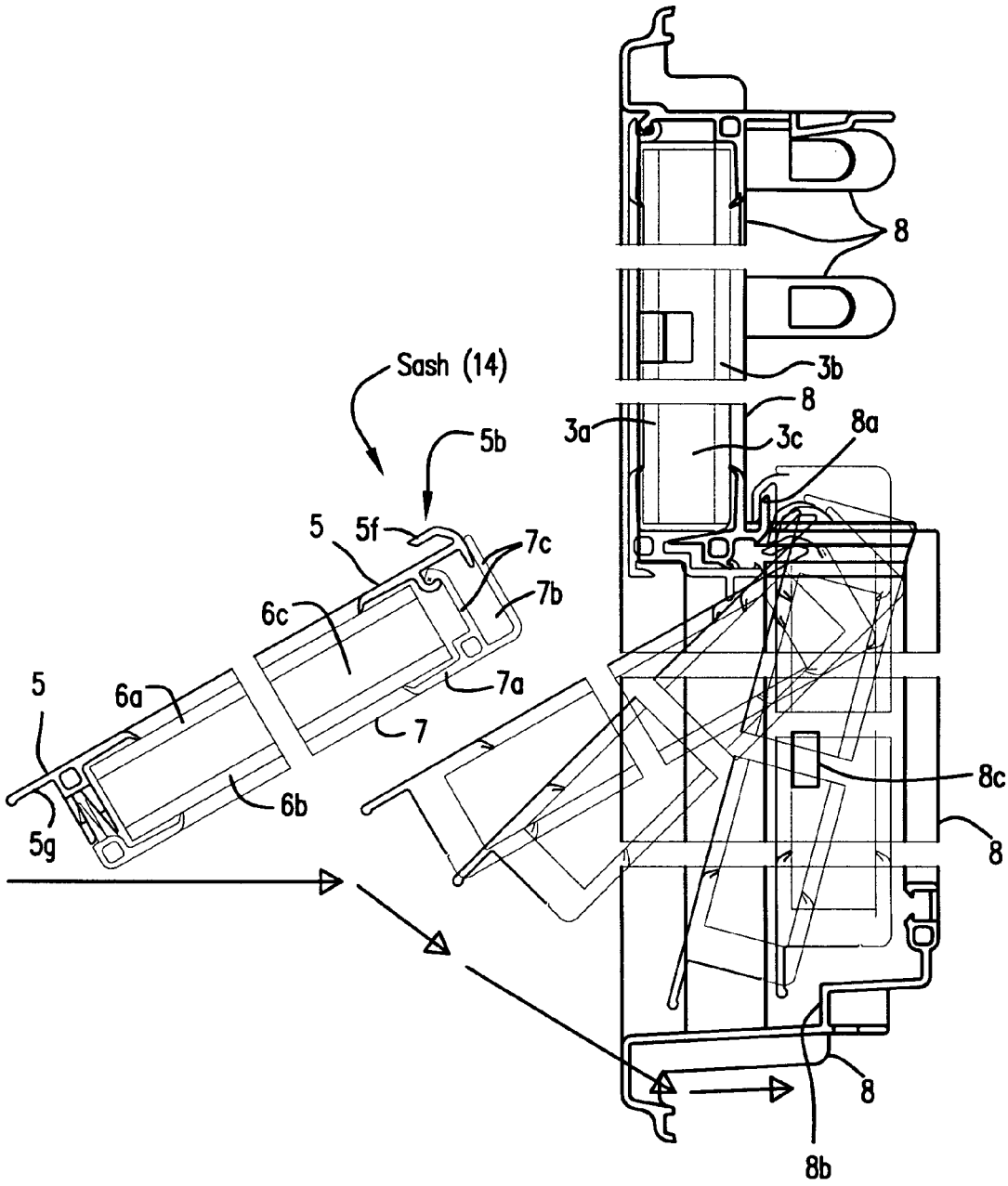
FIG. 4 is a schematic diagram illustrating the assembled sash being inserted into at least the exterior main frame in a pivoting manner and retained thereby according to an example embodiment of this invention.

FIG. 4 is a schematic diagram illustrating the assembled sash 14 (assembled in FIG. 2) being attached to at least the exterior main frame 8 in a pivoting manner according to an example embodiment of this invention. At least one of the extensions 5*f* of the approximately T-shaped edge support 5*b* of exterior sash frame 5 includes an approximately curved and hook shaped end portion. In order to attach the sash 14 to the exterior main frame 8 (e.g., insert the sash 14 into the exterior main frame 8), it can be seen that this approximately hook-shaped end portion of extension 5*f* is engaged with at least an end of a projection 8*a* extending from part of the exterior main frame thereby defining a pivot axis within the hook-shaped end portion about which the sash 14 is to approximately rotate/pivot during installation and/or removal. Once the hook-shaped end portion of extension 5*f* is engaged, the sash 14 is pivoted about the pivot axis as shown in FIG. 4 until the sash is located within at least part of the exterior main frame 8 so that the glazing 6 is approximately parallel to glazing 3. There need not be any snap-fit attachment of the sash 14 to the exterior main frame 8 in this example embodiment (although it is possible in certain embodiments, but not shown in the figures herein). In certain example embodiments, ledge 8*b* may engage projection 5*g* in order to prevent the sash 14 from moving too far. Moreover, significant lateral and/or vertical movement in one direction is prevented by the engagement of the hook-shaped end portion of extension 5*f* with the end of projection 8*a* of the frame 8.

Figure 5:
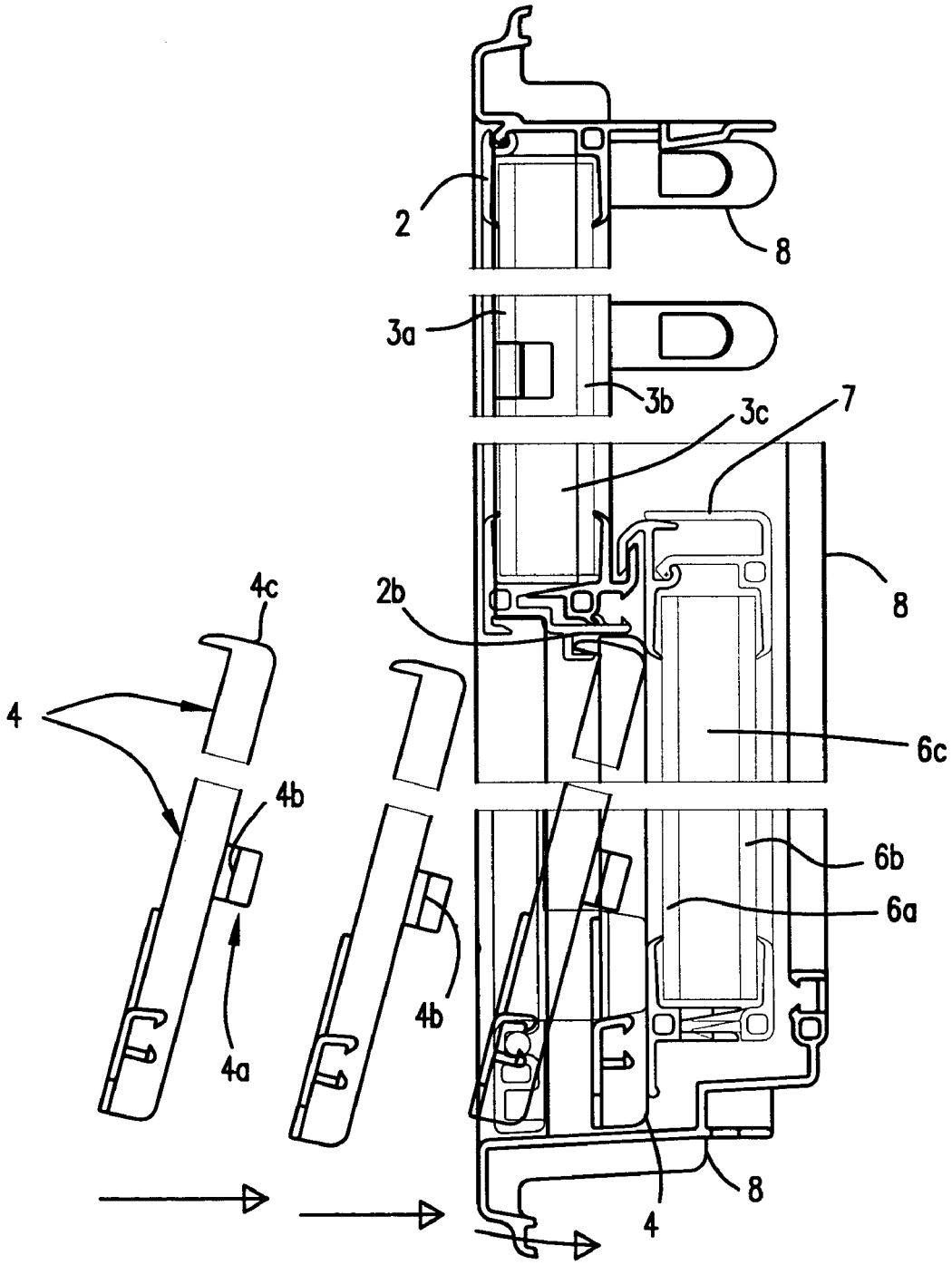
FIG. 5 is a schematic diagram illustrating attachment of the mask of the mobile sash to at least the exterior main frame, where end portion(s) of the mask engage structure proximate and/or at the mullion of the exterior main frame (e.g., the structure may be part of the fixed glazing mask in certain example instances) to provide a pivot axis about which the mask pivots so that barb(s) of the mask can engage respective recess(es) defined in the exterior main frame in a snap-fit manner; thereby allowing the mask to substantially lock and/or hold at least the assembled sash in place.

FIG. 5 is a schematic diagram illustrating attachment of the mask 4 of the mobile sash 14 to at least the exterior main frame 8, where end portion(s) of the mask 4 engage structure proximate and/or at the mullion of the exterior main frame to provide a pivot axis about which the mask pivots so that barb(s) of the mask 4 can engage respective recess(es) defined in the exterior main frame in a snap-fit manner; thereby allowing the mask 4 to substantially lock and/or hold at least the assembled sash 14 in place within frame 8. It can be seen in FIG. 5 that mask 4 includes one or more projections 4*a* having a barb(s) 4*b* thereon for engagement with the frame 8.

Still referring to FIG. 5, in order to attach the mobile sash mask 4 to at least the exterior main frame 8, curved end portions 4*c* (see FIGS. 1 and 5) of the approximately U-shaped mask 4 are engaged proximate the mullion of the frame 8 in a cavity and/or step defined by a substantially U-shaped portion 2*d* at least partially defined by projection 2*b* of the fixed glazing mask 2 thereby defining a pivot axis as shown in FIG. 5 about which the mask 4 is to approximately rotate/pivot during installation and/or removal. Once the curved end portions 4*c* have been engaged, the mask 4 is pivoted about the pivot axis as shown in FIG. 5 until at least one barb 4*b* supported by a projection 4*a* engages with an opposing barb and/or recess 8*c* defined on or in the exterior main frame 8 (note: recess 8*c* is best shown in FIGS. 3–4 for purposes of simplicity), or some other part of the window. Thus, due to the engagement of barb(s) 4*b*, the mask 4 is attached to the frame 8 in a snap-fit manner to substantially lock and/or hold at least the assembled sash 14 in place within at least part of the frame 8. It is noted that herein, the word "pivoting" covers both exact pivoting and approximate pivoting, as it can be seen that some pivot axes herein may move during rotational movement of components being pivoted. The mask 4 may be removed by reversing these steps.

Figure 6:
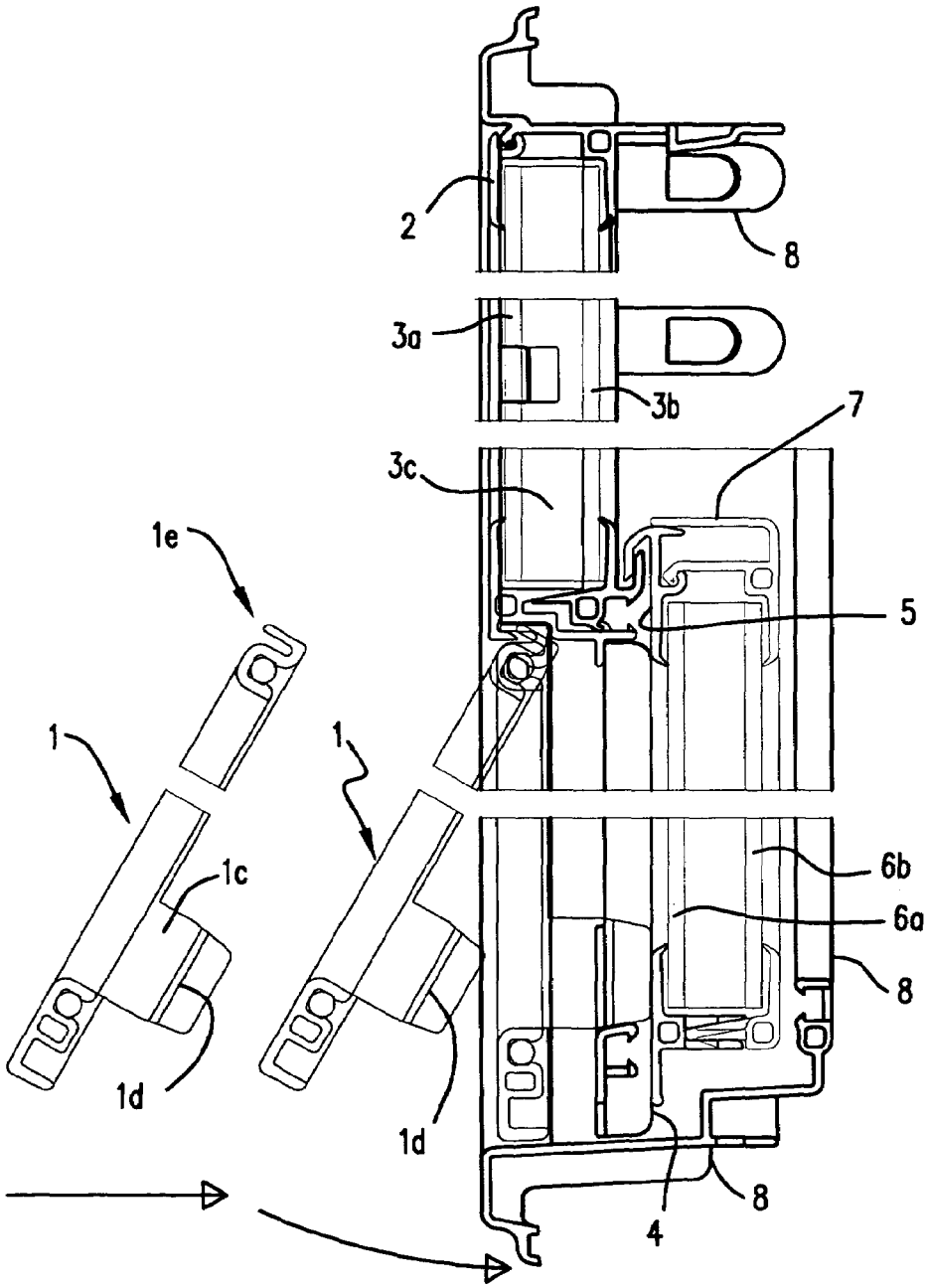
FIG. 6 is a schematic diagram illustrating attachment of the insect screen structure, wherein end portion(s) of the screen structure engage structure proximate and/or at the mullion of the exterior main frame to provide a pivot axis about which the screen pivots so that barb(s) of the screen structure can engage respective recess(es) defined in the sash mask in a snap-fit manner; thereby allowing the screen structure to be attached to at least the sash mask.

FIG. 6 is a schematic diagram illustrating attachment of the insect screen structure 1, wherein end portion(s) of the screen structure engage structure proximate and/or at the mullion of the exterior main frame 8 to provide a pivot axis about which the screen pivots so that barb(s) of the screen structure can engage respective recess(es) or the like defined in the sash mask 4 in a snap-fit manner; thereby allowing the screen structure to be attached to at least the sash mask 4 and/or other window component. Screen structure 1 includes a peripheral frame 1*a*, screen portion 1*b*, and one or more projections 1*c* supporting barbs 1*d* as shown in FIGS. 1 and 6. Moreover, the screen structure includes a curved and approximately hook-shaped end portion 1*e* for engagement with structure proximate the mullion of the frame 8. In order to attach the screen structure 1 to the window structure, curved and hook-shaped end portion 1*e* of the screen structure is engaged proximate the mullion of the frame 8 in a cavity defined by an approximately U-shaped portion 2*e* (see FIGS. 3 and 6) of fixed glazing mask 2 thereby defining a pivot axis as shown in FIG. 6 about which the screen structure 1 is to approximately rotate/pivot during installation and/or removal. Once the hook-shaped end portion 1*e* has been engaged, the screen structure 1 is pivoted about the pivot axis as shown in FIG. 6 until at least one barb 1*d* supported by a projection 1*c* engages with a wall, barb and/or recess defined by sash mask 4 as best shown in FIGS. 1 and 6. Thus, due to the engagement of barb(s) 1*d*, the screen structure 1 is attached to the frame 8 via the sash mask 4 in a snap-fit manner and/or via mask 2, over at least part of the mask 4.

Figure 7:
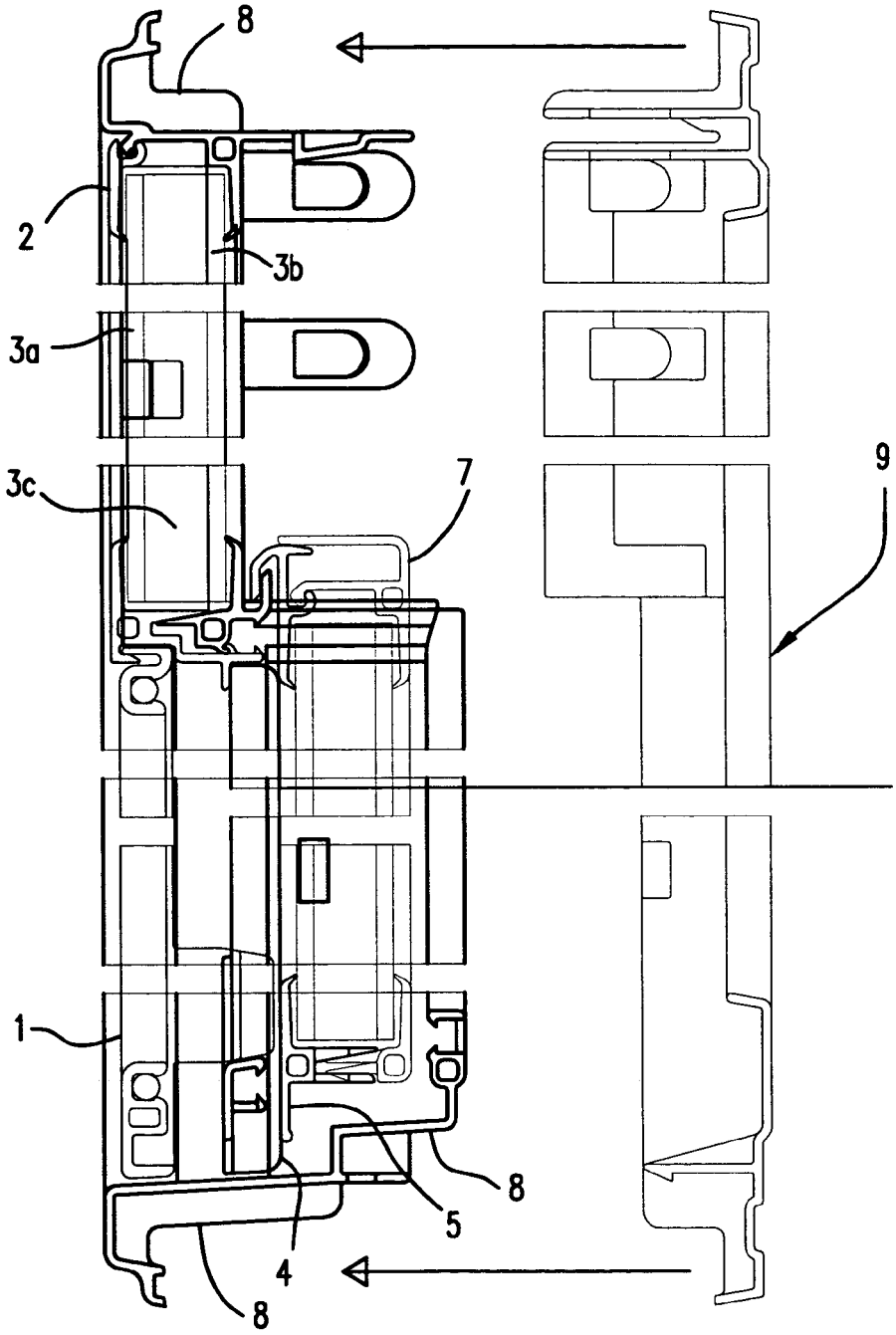
FIG. 7 is a schematic diagram illustrating attachment of the interior main frame to at least the exterior main frame.

Thereafter, the window structure of FIG. 6 may be shipped to customers or the like and installed in doors, walls, and/or the like. After installation of the window structure of FIG. 6 in a door or wall, interior main frame 9 is attached to the exterior main frame 8 as shown in FIG. 7. As explained above, the snap-fit attachments may only be accessible from the interior of the window/building/door, and/or if the sash has been raised or removed. Each of these ways in which the snap-fit attachments may be accessed is based upon access or actions taken on the interior side of the window, thereby allowing for good security to be realized. Example final window products are illustrated in FIGS. 8–9 as discussed above.

Various components of this invention may be made of different materials in different embodiments of this invention. However, in certain example embodiments, components such as masks 2 and/or 4, frame portions 5, 7, 8 and/or 9, may be made of or include polymer materials such as PVC, PP, and/or the like. Other polymer based materials may instead be used in other embodiments. Solid portions of the illustrated components may be formed by injection molding in certain embodiments of this invention.

The embodiment discussed above is for purposes of example. Thus, in other example embodiments of this invention, the male/female components for defining pivot means and snap-fit engagement means can be switched between components. As an example, in the FIG. 2 embodiment, the hook-shaped member for the pivot means could be provided on frame 7 instead of frame 5. As another example, in the FIG. 3 embodiment, the hook-shaped member for the pivot means could be provided on frame 8 instead of mask 2. Moreover, the different snap-fit engagement structures defined herein and the different pivoting structures defined herein may or may not be used in combination with each other in different embodiments of this invention. For purposes of example only, and without limitation, the FIG. 2 system may be provided but not the FIG. 3 system in certain example embodiments of this invention, and vice versa. As another example, the FIG. 4 system may be provided but not the FIG. 2 and/or 3 system in certain example embodiments of this invention, and vice versa. As yet another example, the FIG. 5 system may be provided but not the FIG. 2, 3 and/or 4 system(s) in certain example embodiments of this invention, and vice versa; and so forth. Moreover, in still further example embodiments of this invention, male and female aspects may be provided on the same part in certain example instances.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

The invention claimed is:

1. A window comprising:

at least one frame, a fixed glazing and a movable glazing, the movable glazing being movable relative to the fixed glazing, an exterior sash frame and an interior sash frame supported by the at least one frame, the movable glazing being supported by at least the interior sash frame, wherein the exterior sash frame comprises first pivot means for pivotal engagement with the interior sash frame, and first snap-fit engagement means for snap-fit engagement with the interior sash frame, so that said first pivot means and first snap-fit engagement means are for permitting the exterior sash frame to be attached and/or removed from the interior sash frame by way of pivoting and snap-fit engagement and/or removal, a glazing mask pivotally attached to the at least one frame proximate the fixed glazing, wherein the glazing mask includes second pivot means and second snap-fit means for permitting the glazing mask to be attached and/or removed from the at least one frame by way of pivoting and snap-fit engagement and/or removal, means for permitting the combination of the exterior sash frame and interior sash frame, in an engaged state, to be pivotally connected to the at least one frame, so as to permit the combination of the exterior and interior sash frames to be attached and/or removed from the at least one frame by way of pivoting, and a mobile sash mask including third pivot means for allowing the mobile sash mask to be pivotally inserted and attached over at least part of the combination of the exterior and interior sash frames.

2. The window of claim 1, further comprising a screen including fourth pivot means for allowing the screen to the glazing mask and over at least part of the movable glazing.

3. The window of claim 1, wherein the pivot means is a hook-shaped member of the exterior sash frame, and wherein the hook-shaped member of the exterior sash frame engages an end of a projection of the interior sash frame so that a pivot axis about which the exterior sash frame pivots is partially surrounded by the hook-shaped member.

4. The window of claim 1, wherein the snap-fit engagement means of the exterior sash frame comprises at least one projection which supports a barb, wherein the barb is for engagement with a recess and/or opposing barb of the interior sash frame.

5. The window of claim 1, wherein the snap-fit engagement means of the exterior sash frame comprises first and second projections which support at least first and second barbs, respectively, wherein the first and second projections are for engagement with respective recesses and/or opposing barbs of the interior sash frame.

6. The window of claim 1, wherein the interior sash frame includes a channel defined between first and second approximately parallel side walls, and wherein said pivot means of the first sash frame engages with at least one of the side walls.

7. A window comprising:

at least one frame, a fixed glazing and a movable glazing, the movable glazing being movable relative to the fixed glazing, an exterior sash frame and an interior sash frame supported by the at least one frame, the movable glazing being supported by at least the interior sash frame, wherein the exterior sash frame pivotally engages the interior sash frame, and snap-fit engages the interior sash frame, so that the exterior sash frame is pivotally attached and/or removed from the interior sash frame, a glazing mask pivotally attached to the at least one frame proximate the fixed glazing, wherein the combination of the exterior sash frame and interior sash frame, in an engaged state, is pivotally connected to the at least one frame, so as to permit the combination of the exterior and interior sash frames to be attached and/or removed from the at least one frame by way of pivoting, and a mobile sash mask pivotally inserted and attached over at least part of the combination of the exterior and interior sash frames.

* * * * *